US011147375B2

(12) United States Patent
Van Ry

(10) Patent No.: US 11,147,375 B2
(45) Date of Patent: Oct. 19, 2021

(54) MILLWORK LEVELER

(71) Applicant: DIRTT Environmental Solutions, LTD., Calgary (CA)

(72) Inventor: Dave C. Van Ry, Okotoks (CA)

(73) Assignee: DIRTT ENVIRONMENTAL SOLUTIONS, LTD., Calgary (CA)

( * ) Notice: Subject to any disclaimer, the term of this patent is extended or adjusted under 35 U.S.C. 154(b) by 0 days.

(21) Appl. No.: 15/741,177

(22) PCT Filed: Feb. 28, 2017

(86) PCT No.: PCT/US2017/019926
§ 371 (c)(1),
(2) Date: Dec. 29, 2017

(87) PCT Pub. No.: WO2017/151601
PCT Pub. Date: Sep. 8, 2017

(65) Prior Publication Data

US 2018/0192773 A1 Jul. 12, 2018

Related U.S. Application Data

(60) Provisional application No. 62/301,812, filed on Mar. 1, 2016.

(51) Int. Cl.
*A47B 91/02* (2006.01)
*A47B 91/16* (2006.01)
(Continued)

(52) U.S. Cl.
CPC ..... *A47B 91/026* (2013.01); *A47B 77/02* (2013.01); *A47B 91/02* (2013.01); *A47B 91/06* (2013.01);
(Continued)

(58) Field of Classification Search
CPC ..... A47B 91/026; A47B 91/12; A47B 91/16; A47B 91/00; A47B 91/005; A47B 91/02;
(Continued)

(56) References Cited

U.S. PATENT DOCUMENTS 323,566 A * 8/1885 Delmont ..... A47B 91/12 5/511
3,159,438 A * 12/1964 Carlson ..... A47B 87/008 108/64
(Continued)

FOREIGN PATENT DOCUMENTS

| | | |
|---|---|---|
| JP | H05-065238 | 8/1993 |
| JP | H11-285417 | 10/1999 |
| JP | 2002-021301 | 1/2002 |

OTHER PUBLICATIONS

International Search Report and Written Opinion for PCT/US2017/019926 dated May 26, 2017.

*Primary Examiner* — Nkeisha Smith
(74) *Attorney, Agent, or Firm* — Workman Nydegger

(57) ABSTRACT

The present disclosure provides systems, components, and methods for leveling millwork. In one or more implementations, a millwork leveling device and/or kit for leveling millwork include a track, a first leveling post, and a second leveling post. The leveling posts are movably positionable along the track. The first leveling post has a first adjustable height and the second leveling post has a second adjustable height. The device and/or kit may further include a plate associated with the first leveling post, the plate having one or more through holes and attaching a finishing piece thereto.

18 Claims, 8 Drawing Sheets

(51) Int. Cl.
*A47B 77/02* (2006.01)
*A47B 91/06* (2006.01)
*A47B 95/00* (2006.01)

(52) U.S. Cl.
CPC ..... *A47B 95/002* (2013.01); *A47B 2095/004* (2013.01)

(58) Field of Classification Search
CPC ... A47B 91/022; A47B 91/024; A47B 91/028; A47B 77/02; A47B 95/002; A47B 2095/004; B44B 2700/12; B44B 3/06; B44B 3/065
USPC .... 248/188.4, 677, 646, 649, 437, 650, 673, 248/188.2, 188.1, 188.8, 188.9, 188.91, 248/346.01, 346.03, 346.05
See application file for complete search history.

(56) References Cited

U.S. PATENT DOCUMENTS 3,493,201 A * 2/1970 Marran ..... F16M 7/00 248/346.03
3,877,671 A * 4/1975 Underwood ..... B61D 45/002 248/346.03
3,960,352 A * 6/1976 Plattner ..... F16M 11/045 248/309.1
4,718,719 A * 1/1988 Brennan ..... B64D 11/06 244/122 R
4,878,645 A * 11/1989 O'Neill ..... F16M 11/22 248/680
5,110,082 A * 5/1992 Rowan, Jr. ..... F16M 7/00 248/649
5,487,523 A * 1/1996 Ingram ..... E05B 73/0082 248/205.3
5,624,098 A * 4/1997 McDowell ..... F24C 3/12 248/188.8
5,887,962 A * 3/1999 Tsai ..... F16M 11/22 248/188.1
5,890,768 A * 4/1999 Beurteaux ..... B63B 29/06 244/122 R
6,536,725 B2 * 3/2003 Fisher ..... A47B 91/022 248/188.4
6,636,418 B1 * 10/2003 Claprood ..... G06F 1/181 248/188.4
6,655,497 B1 * 12/2003 Weatherall ..... E06C 7/426 182/108
6,923,419 B2 * 8/2005 George ..... A47B 91/005 248/188.4
7,073,629 B2 * 7/2006 Gardner ..... E06C 7/44 182/108
7,775,498 B2 * 8/2010 Phillips ..... A47L 15/4253 248/500
8,138,469 B2 * 3/2012 Dittmer ..... F16M 11/041 250/221
8,337,026 B2 * 12/2012 Chen ..... G03B 21/145 248/324
8,382,056 B2 * 2/2013 Le Masurier ..... E06C 7/426 182/2.2
8,777,025 B1 * 7/2014 Buckleitner ..... A47F 5/04 211/13.1
8,840,079 B2 * 9/2014 Lin ..... F16M 7/00 248/346.01
9,498,664 B2 * 11/2016 Lorentz, II ..... A63B 21/00047
9,826,834 B2 * 11/2017 Hovenden ..... A47B 91/024
9,835,284 B2 * 12/2017 Gandole ..... F16M 7/00
9,987,993 B2 * 6/2018 Thorimbert ..... B60R 7/14
10,124,447 B2 * 11/2018 Siegmund ..... B23K 37/0461
10,227,723 B2 * 3/2019 Zhao ..... D06F 39/125
2003/0160496 A1 * 8/2003 McFadden ..... A47B 91/12 297/463.1
2010/0321646 A1 * 12/2010 Nakano ..... G03B 21/14 353/119
2012/0280607 A1 * 11/2012 Doberstein ..... F25D 23/00 312/401
2013/0313385 A1 * 11/2013 Mora ..... F16M 7/00 248/188.4
2014/0028168 A1 1/2014 Klinke
2015/0320221 A1 11/2015 Williams et al.
2016/0123078 A1 * 5/2016 Bouthillier ..... E06B 11/045 49/420

* cited by examiner

MILLWORK LEVELER

CROSS-REFERENCE TO RELATED APPLICATIONS

The present invention is a 35 U.S.C. § 371 U.S. National Stage of PCT Application No. PCT/US2017/019926, filed Feb. 28, 2017, which claims the benefit of U.S. Patent Application No. 62/301,812, filed on Mar. 1, 2016, and entitled MILLWORK LEVELER. The entire content of each of the foregoing patent applications is incorporated herein by reference.

BACKGROUND

1. Technical Field

This disclosure relates to apparatus, systems, and methods for leveling millwork and other objects.

2. Relevant Art

There are many issues that must be considered when constructing a building, but perhaps foremost among those issues is ensuring that a building is level. Many factors affect how level a building is, generally, and how level a floor is, specifically, within that building. For example, the building's foundation may set unevenly and cause a slight sloping or warping of the floor and any floors built thereupon. As further examples, the framing material used in creating the building's infrastructure may not be cut or measured to exactly the same lengths, the flooring material may be of unequal thickness or the flooring material may, itself, be warped—all of which may potentially cause unevenness throughout the structure.

Any unevenness within the general structure of a building will perpetuate to any structures attached thereto, including, for example, millwork. Millwork includes many ready-made carpentry elements installed within a building such as, for example, cabinets, doors, and window casings. If a floor is uneven, it will affect any millwork attached to it. For example, some cabinets rest on the floor, and an uneven floor translates to an uneven cabinet if the cabinet is simply attached thereto without any adjustments. This may cause myriad issues and annoyances, including, for example, a cabinet door or drawer that will not remain closed, an aesthetically unappealing cabinetry façade where one or more cabinet faces are angled or skewed from level, and/or an uneven work surface (e.g., a countertop) attached to the top of the cabinets.

Some adjustable posts are known in the art that allow for leveling, for example, cabinets. In particular, adjustable posts are singly applied to the underside four corners of each cabinet such that each cabinet has four adjustable posts supporting it. This provides the advantage of being able to individually adjust the height of each corner of the cabinet to ensure a level installation.

Unfortunately, it is difficult to manage and adjust the individual posts associated with each cabinet, and furthermore, it can be cumbersome to connect a toe kick to the cabinet while simultaneously avoiding interference with the labyrinth of adjustable posts. Accordingly, there remains room for improvement in the area of leveling millwork.

BRIEF SUMMARY

Implementations of the present disclosure provide systems, components, and methods for leveling millwork. In one or more implementations, a millwork leveling device comprises a track and a leveling post that is movably positionable along the track. The height of the leveling post is selectively adjustable. The device may further include a plate that is associates with the leveling post. The plate can include one or more through holes configured to attach to a finishing piece.

In one or more additional or alternative implementations, the leveling device can include a second leveling post that is movably positionable along the track. The second leveling post may have an adjustable height.

In one or more additional or alternative implementations, the plate that is associated with the leveling post can freely rotate about the leveling post. The plate may, additionally or alternatively, to attach to the finishing piece utilizing the one or more through holes.

Implementations of the present disclosure further provide methods for leveling millwork. In one or more implementations, the method may include the step of positioning a leveling device on a first surface. The leveling device may include a track, a first adjustable height leveling post and second adjustable height leveling post movably positionable along the track, and a plate associated with the first leveling post. The place may have one or more through holes to facilitate attachment to a finishing piece. The method may include the step of associating a millwork with the leveling device, where the millwork has at least a horizontal axis. The method may also include leveling the millwork with respect to the first surface by adjusting at least the height of the first leveling post.

In one or more additional or alternative implementations, leveling the millwork may comprise adjusting at least one of the first adjustable height leveling post and the second adjustable height leveling post until the horizontal axis of the millwork is perpendicular to a line representing the force of gravity.

Implementations of the present disclosure may also include a kit for leveling millwork. In one or more implementations, the kit may include a track and two leveling posts (a first leveling post and a second leveling post) that are movably positionable along the track. In some implementations, the first leveling post has a first adjustable height and the second leveling post has a second adjustable height. The kit may further include a plate associated with the first leveling post. The plate may have one or more through holes configured to facilitate attachment to a finishing piece.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the present disclosure can be obtained, a more particular description will be rendered by reference to specific embodiments which are illustrated in the appended drawings. Understanding that these drawings depict only typical embodiments of the disclosure and are not therefore to be considered to be limiting of its scope, the embodiments will be described and explained with additional specificity and detail through the use of the accompanying drawings in which.

DETAILED DESCRIPTION

Figure 1A:
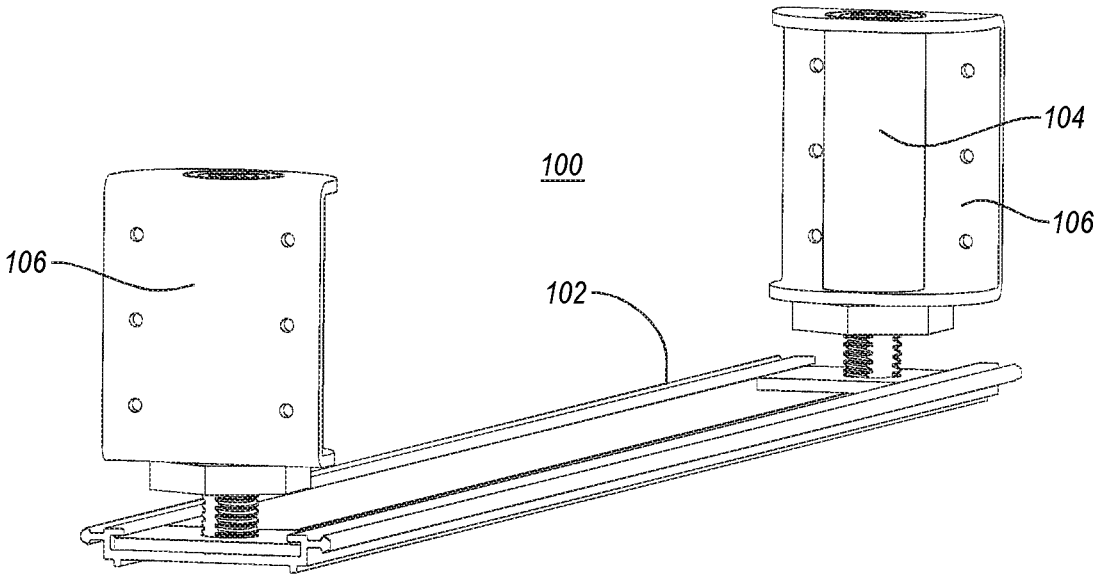
FIG. 1A illustrates a perspective view of a millwork leveling device according to one or more implementations of the present disclosure.

The present disclosure extends to systems, components, and methods for leveling millwork. In one or more implementations, a millwork leveling device comprises a track and a leveling post that is movably positionable along the track. The height of the leveling post is selectively adjustable. The device may further include a plate that is associates with the leveling post. The plate can include one or more through holes configured to attach to a finishing piece.

In one or more additional or alternative implementations, the leveling device can include a second leveling post that is movably positionable along the track. The second leveling post may have an adjustable height.

In one or more additional or alternative implementations, the plate that is associated with the leveling post can freely rotate about the leveling post. The plate may, additionally or alternatively, to attach to the finishing piece utilizing the one or more through holes.

Implementations of the present disclosure further provide methods for leveling millwork. In one or more implementations, the method may include the step of positioning a leveling device on a first surface. The leveling device may include a track, a first adjustable height leveling post and second adjustable height leveling post movably positionable along the track, and a plate associated with the first leveling post. The place may have one or more through holes to facilitate attachment to a finishing piece. The method may include the step of associating a millwork with the leveling device, where the millwork has at least a horizontal axis. The method may also include leveling the millwork with respect to the first surface by adjusting at least the height of the first leveling post.

In one or more additional or alternative implementations, leveling the millwork may comprise adjusting at least one of the first adjustable height leveling post and the second adjustable height leveling post until the horizontal axis of the millwork is perpendicular to a line representing the force of gravity.

Implementations of the present disclosure may also include a kit for leveling millwork. In one or more implementations, the kit may include a track and two leveling posts (a first leveling post and a second leveling post) that are movably positionable along the track. In some implementations, the first leveling post has a first adjustable height and the second leveling post has a second adjustable height. The kit may further include a plate associated with the first leveling post. The plate may have one or more through holes configured to facilitate attachment to a finishing piece Throughout this specification, reference is made to millwork. A millwork can comprise any individual ready-made carpentry element that an owner or installer can install within a building. For example, a cabinet, a door, and a window casing are each, individually, millworks. The disclosure, however, is not limited to the foregoing examples, but also extends to any ready-made carpentry element that an owner or installer can install within a building. For the purposes of this disclosure, a millwork may also include non-carpentry elements that serve the same or similar function as their wood or wood-based counterparts. For example, a cabinet, door, or window casing made of metal, stone, plastic, thermoplastic, or other non-wood-based material is intended to be included within the understanding of the term millwork as used herein.

Figure 1B:
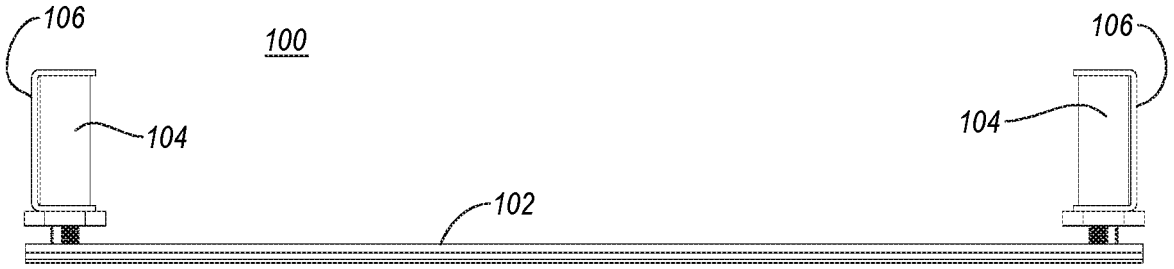
FIG. 1B illustrates a side view of the millwork leveling device of FIG. 1A.
Figure 1C:
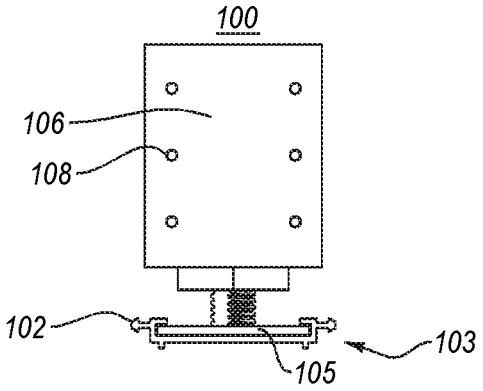
FIG. 1C illustrates an end-on view of the millwork leveling device of FIGS. 1A and 1B.

With reference now to the figures, FIGS. 1A-1C illustrates various views of a millwork leveling device 100. FIG. 1A, for example, illustrates a perspective view of the millwork leveling device 100. As depicted, the millwork leveling device 100 includes a track 102, two leveling posts 104, and a plate 106 associated with each leveling post 104. In some embodiments, the number and placement of the leveling posts may vary. For example, a track may have a single leveling post or a plurality of leveling posts (e.g., three, four, five, six, or more leveling posts on a single track).

In one or more embodiments, each leveling post 104 may be associated with a plate 106. For example, a manufacturer may weld or otherwise fixedly attach the plate 106 to the post 104. The plate 106 may, in one or more embodiment, be stationary and/or immovable with respect to the post 104. In another embodiment, a manufacturer may fixedly attach the plate 106 to the post 104 in a way that still allows the plate 106 and/or the post 104 to be movable relative to one another. For example, the plate 106 may rotate about the post 104 and/or the post 104 may rotate relative to the plate 106. As another example, the plate 106 may be removably associated with the post 104. In one or more embodiments, this may include snapping to the plate 106 or magnetically attaching to the plate 106 to the post 104.

In one or more embodiments, one or more of the leveling posts 104 associated with the track 102 may not have an associated plate 106. For example, a track 102 may have three leveling posts 104 where one of the leveling posts 104 is disposed of between the other two leveling posts 104, and the leveling post 104 between the other two leveling posts 104 may not have an associated plate 106, whereas both of the flanking leveling posts 104 do have an associated plate 106. Alternatively or additionally, only one of the three leveling posts 104 may have an associated plate 106. In one embodiment, the track 102 depicted in FIG. 1 may comprise two leveling posts 104 wherein only one of the leveling posts 104 is associated with a plate 106.

FIG. 1B illustrates the millwork leveling device 100 from a side view. As depicted, the millwork leveling device includes the two leveling posts 104 at opposing ends of track 102. In some embodiments, and as more clearly illustrated in FIG. 1C, a manufacturer or installer can position leveling posts 104 within the track 102 such that the leveling posts 104 are movable along the track 102 by, for example, sliding the leveling posts 104 within and/or on the track 102. In one embodiment, track 102 includes grooves 103 and the leveling posts 104 include a base 105. The grooves 103 may guide the bases 105 along the track 102 and/or confine the bases 105 to substantially the same region as the track 102.

In some embodiments, the track may include one or more pre-defined positions along the track. The one or more pre-defined positions may accept a leveling post. For example, a track according to the foregoing embodiment, may include leveling post docking points at measured, pre-defined, and/or user-defined intervals along the track that may, for example, snappingly receive a leveling post.

In one or more embodiments, the leveling posts 104 may be, as depicted in the various illustrated views of FIG. 1, substantially similar. However, in some embodiments the leveling posts may be dissimilar.

Figure 2:
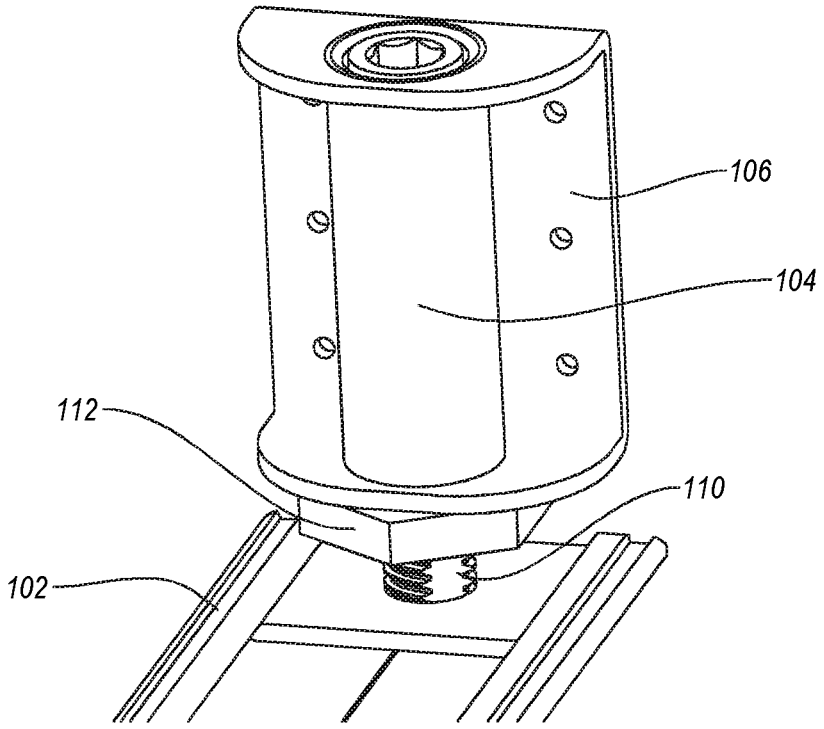
FIG. 2 illustrates a height adjustable leveling post of the millwork leveling device of FIGS. 1A-1C.

Referring now to FIG. 2, depicted is a leveling post 104 associated with plate 106 and track 102. Leveling post 104 is further associated with threaded rod 110. As depicted, the threaded rod 110 extends partially within the leveling post 104. At least a portion of an interior surface of the leveling post 104 includes threads to threadingly engage the threaded rod 110. The threaded rod 110 is also, as depicted in FIG. 2, associated with a height adjustment device 112. As shown, the height adjustment device 112 and threaded rod 110 may be similar (e.g., in function) to a nut (i.e., a fastener with a threaded hole) and bolt where the nut is threaded about the bolt. In this configuration, a user or installer can adjust the height of the leveling post 104 up or down by rotating the height adjustment device 112 along threaded rod 110. The leveling device 104 rests upon or is otherwise configured to move together with (or as a consequence of) adjusting the height adjustment device 112. In some embodiments, the threaded rod 110 and the height adjustment device 112 may be considered as parts or additional components of the leveling post 104.

In one embodiment, the threaded rod may include (e.g., in its structure) the height adjustment device and/or the functional equivalent thereof. Additionally or alternatively, a manufacturer may form the threaded rod without threads, but still in a manner that enables a user or installer to adjust the height of the height adjustment device along the same or similar axis.

Figure 3A:
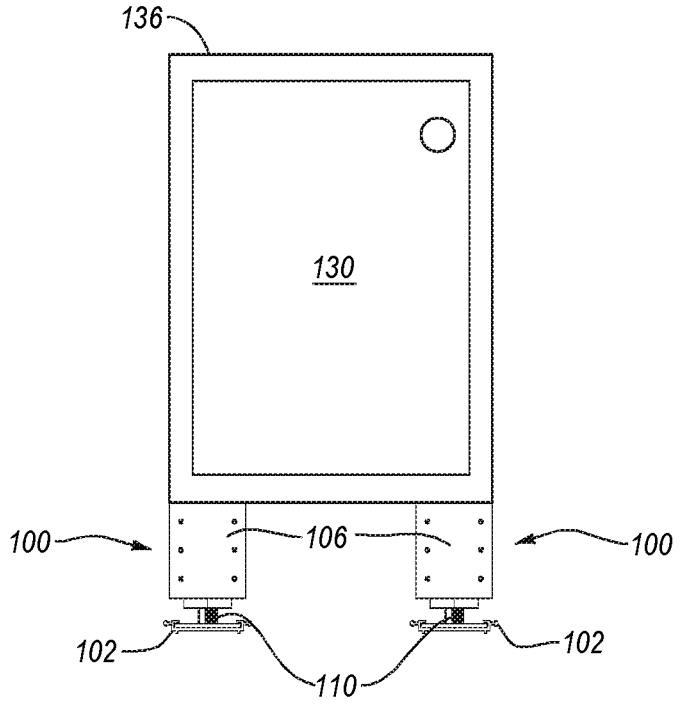
FIG. 3A illustrates a front view of millwork leveling devices associated with a cabinet according to one or more implementations of the present disclosure.
Figure 3B:
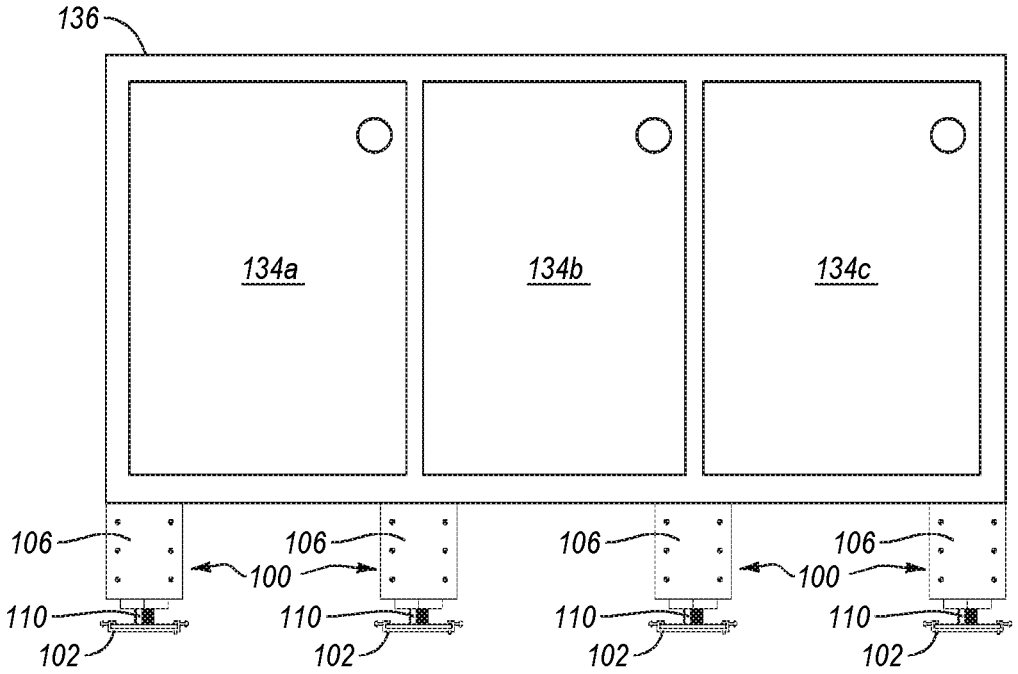
FIG. 3B illustrates a front view of a plurality of millwork leveling devices associated with cabinets according to one or more implementations of the present disclosure.
Figure 3C:
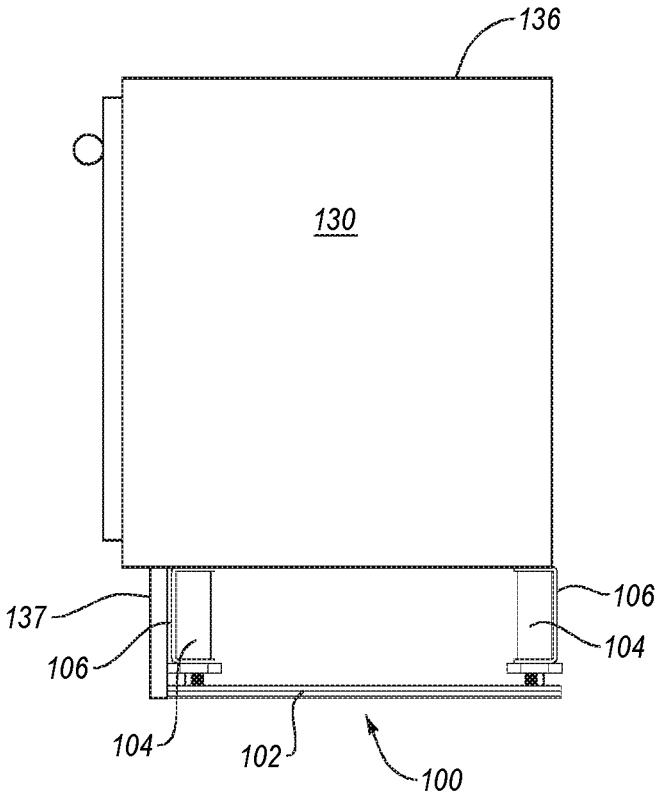
FIG. 3C illustrates a side view of a millwork leveling device associated with a cabinet according to one or more implementations of the present disclosure.

Referring now to FIGS. 3A-3C, depicted are one or more millwork leveling devices associated with one or more cabinets according to one or more implementations of the present disclosure. Though the Figures depict cabinets, other millworks may be interchangeable without departing from the scope or intent of the disclosure. FIG. 3A, in particular, illustrates a single cabinet 130 positioned atop and/or associated with two millwork leveling devices 100, each millwork leveling device 100 positioned by a corner and/or substantially near an edge of the cabinet 130 in a manner to support the cabinet 130.

FIG. 3B illustrates a plurality of cabinets 134*a*, 134*b*, 134*c* supported by and/or associated with a plurality of millwork leveling devices 100. As depicted, an installer has positioned the millwork leveling devices 100 at and/or near the outermost edges of cabinets 134*a* and 134*c*, and other millwork leveling devices 100 at and/or near the joining region of cabinets 134*a* and 134*b* and cabinets 134*b* and 134*c*. As depicted, an installer has positioned the millwork leveling devices 100 at equal or approximately equal distances from one another. In one embodiment, an installer can position the millwork leveling devices at irregular intervals and/or user-specified positions. In one embodiment, the maximum distance between two adjacent millwork leveling devices is 30 inches. In other embodiments, the distance between two adjacent millwork leveling devices may be any of, a combination of, or any distance between the following: less than one inch, one inch, two inches, six inches, 12 inches, 18 inches, 24 inches, 36 inches, 42 inches, 48 inches, 54 inches, 60 inches, 66 inches, 72 inches, 78 inches, 84 inches, 90 inches, 96 inches, 102 inches and/or more than 102 inches.

FIG. 3C depicts a side view of the cabinet 130 from FIG. 3A. As depicted, millwork leveling device 100 comprises two leveling posts 104. One leveling post 104 is positioned at or near the rear of the cabinet 130, and the other leveling post 104 is positioned near the front end of cabinet 130 but recessed with respect to the front end of the cabinet 130. As depicted, the plate 106 of the forward most leveling post 104 (the leveling post near the front end of the cabinet) is facing outward. The plate 106 may, in some embodiments, facilitate attachment of a finishing piece 137, such as, for example, a toe kick. In one embodiment, the finishing piece 137 is molding. In another embodiment, the finishing piece may be a drawer, retractable step, access panel, vent, or similar.

In one embodiment, an installer can attach the finishing piece 137 to the millwork leveling device 100 by associating and/or attaching the finishing piece 137 to the plate 106 via one or more through holes 108 (See FIG. 1C). For example, an installer may nail, bolt, screw, glue, or otherwise adhere the finishing piece 137 to the plate 106. In one embodiment, an installer may attach the finishing piece 137 to the plate 106 without utilizing one or more through holes 108.

In one embodiment, the cabinet 130 is a floor level cabinet (e.g., kitchen cabinet) and the surface 136 is a counter top, desk top, or other functional surface. The positioning of the millwork leveling device 100 and the attachment of a finish piece 137 (e.g., a toe kick) provides the expected aesthetics and functionality of a recessed toe kick.

Figure 4A:
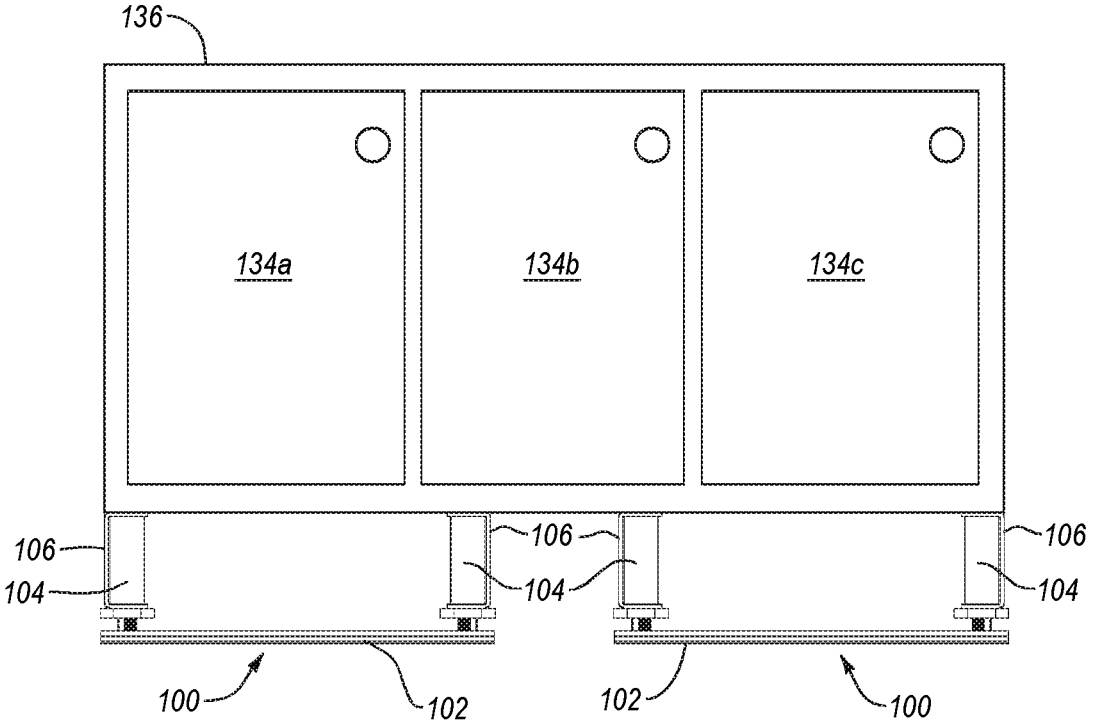
FIG. 4A illustrates a front view of millwork leveling devices associated with cabinets according to one or more implementations of the present disclosure.
Figure 4B:
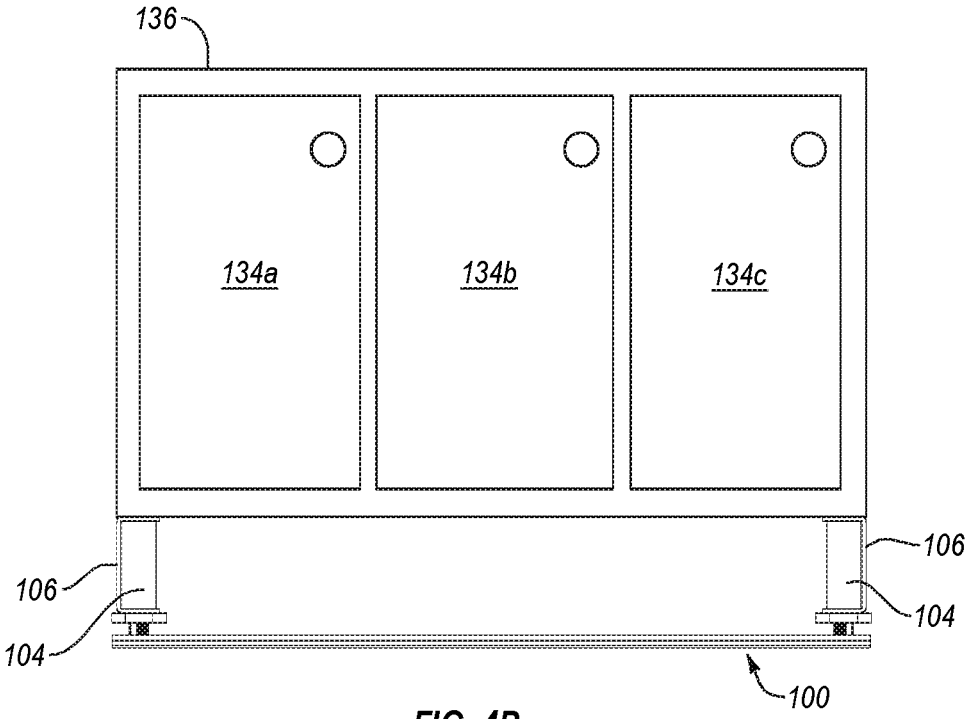
FIG. 4B illustrates a front view of millwork leveling devices associated with cabinets according to one or more implementations of the present disclosure.
Figure 4C:
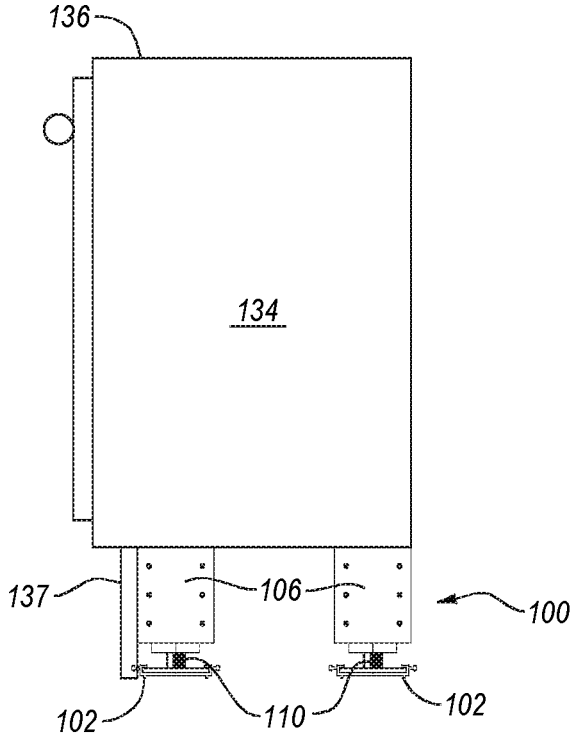
FIG. 4C illustrates a side view of millwork leveling devices associated with a cabinet according to one or more implementations of the present disclosure.

FIGS. 4A-4C depict other embodiments of millwork leveling device positioning with respect to a millwork (e.g., a cabinet). For example, 4A depicts a pair of millwork leveling devices 100, each having two individual leveling posts 104 positioned beneath cabinets 134. As opposed to embodiments depicted by FIGS. 3A-3C, where the tracks 102 of the millwork leveling devices 100 (and thereby the leveling posts 104) were positioned substantially perpendicular to the front face of the cabinets 134, the tracks 102 of millwork leveling devices 100 in FIGS. 4A-4C are positioned substantially parallel to the front face of cabinets 134.

In some embodiments, and similar to embodiments represented by FIGS. 3A-3C, each individual leveling post 104 of FIGS. 4A-4C may support an edge and/or any other position beneath the cabinets 134, including at or near the joining regions of cabinets 134*a* and 134*b* as well as the joining regions of cabinets 134*b* and 134*c*.

As depicted in FIGS. 4A and 4B, the number and spacing of millwork leveling devices may vary. FIG. 4A depicts two millwork leveling devices 100 spaced apart by a given distance less than the width of cabinet 134*b*. In one embodiment, an installer can position the millwork leveling devices at irregular intervals and/or user-specified positions. In one embodiment the maximum distance between two adjacent millwork leveling devices is 30 inches. In other embodiments, the distance between two adjacent millwork leveling devices may be any of, a combination of, or any distance between the following: less than one inch, one inch, two inches, six inches, 12 inches, 18 inches, 24 inches, 36 inches, 42 inches, 48 inches, 54 inches, 60 inches, 66 inches, 72 inches, 78 inches, 84 inches, 90 inches, 96 inches, 102 inches and/or more than 102 inches.

In some embodiments, a user or installer may rotate the plates 106 associated leveling posts 104 such that the faces of plates 106 are parallel with the front faces of cabinets 134. An installer can then associate a finishing piece (e.g., finishing piece 137 in FIG. 3C) with the plates 106 by, for example, any of the methods previously described.

Referring now to FIG. 4C, depicted is a side view of cabinets 134 representative of either and/or both of FIGS. 4A and/or 4B. Similar to embodiments described for FIGS. 3A-3C, an installer can recess the front-most millwork leveling device 100 from the front of the cabinet 134 to provide a toe kick, for example, if the cabinet 134 is a floor-level kitchen cabinet. In some embodiments, an installer can position the front-most millwork leveling device 100 beneath or substantially beneath the front-most edge of cabinets 134. An installer can also associate a finishing piece 137 with the plates 106 as noted above and shown in FIG. 4C.

In some embodiments, cabinets 134 may be a millwork containing multiple cabinets, and in other embodiments, the cabinets 134 may be a single cabinet.

Figure 5:
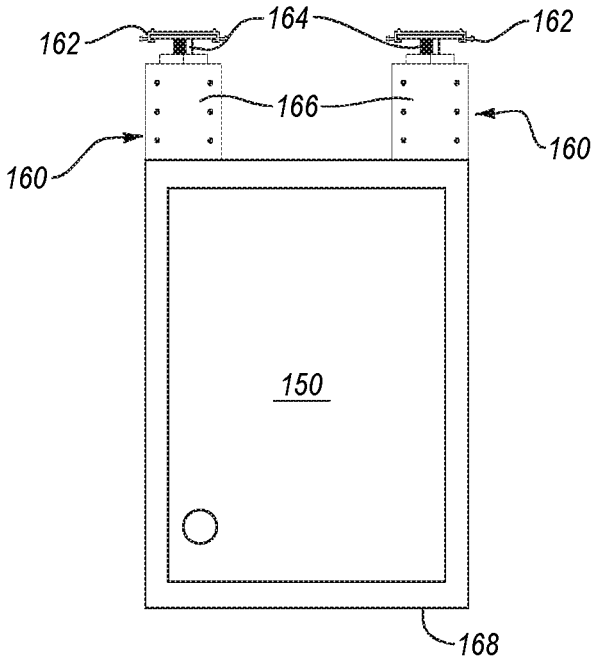
FIG. 5 illustrates a front view of millwork leveling devices associated with the top surface of a cabinet according to one or more implementations of the present disclosure.

Referring now to FIG. 5, depicted is a cabinet 150 associated with two millwork leveling devices 160. As depicted, the millwork leveling devices 160 are associated with a top surface of cabinet 150. In some embodiments, an installer may securely attach the millwork leveling devices 160 to a ceiling and/or another surface for hanging cabinet 150. For instance, an installer may adhere or couple track 162 to the ceiling and/or other surface. In some embodiments, an installer or manufacturer may anchor the leveling posts of the millwork leveling device 100 to the cabinet to secure the cabinet to the ceiling or other surface. In some embodiments, there is a separate anchoring piece. An installer may adjust the height and/or leveling of the cabinet 150 by raising and/or lowering one or more leveling posts of the millwork leveling devices 160. For instance, an installer may rotate or otherwise adjust a height adjustment device 164 of one or more of the millwork leveling devices 160.

A manufacturer or installer may associate the plates 166 with the millwork leveling device 160 and/or position the plates 166 parallel to the front face of cabinet 150. An installer may associate a finishing piece with the plates 166 (e.g., by attaching the finishing piece to the plates according to any of the embodiments described above for associating a finishing piece with a plate). The finishing piece may be a piece of molding or any other finishing piece described herein or in accordance with the scope and intent of this disclosure.

The height of any and/or all leveling posts depicted in FIGS. 3A-5 may be individually adjustable. In one embodiment, an installer or user may adjust the height of the leveling posts to level the associated millwork such that the surface (e.g., surface 136 of FIGS. 3A-4C and surface 168 of FIG. 5) of the millwork is level. In one embodiment, the millwork is level when a line that represents the force of Earth's gravitational pull is perpendicular to the aforementioned surface. In another embodiment, the surfaces 136, 168 are level at an angle decided by the user. In one embodiment, the heights of some but not all of the leveling posts are adjustable.

In one or more embodiment, the millwork leveling device may be associated with a vertical surface of a structure and to a vertical surface of the millwork (e.g., the backside of a cabinet). A user or installer may level the millwork in a similar manner as described above by adjusting the height of associated leveling posts.

Figure 6:
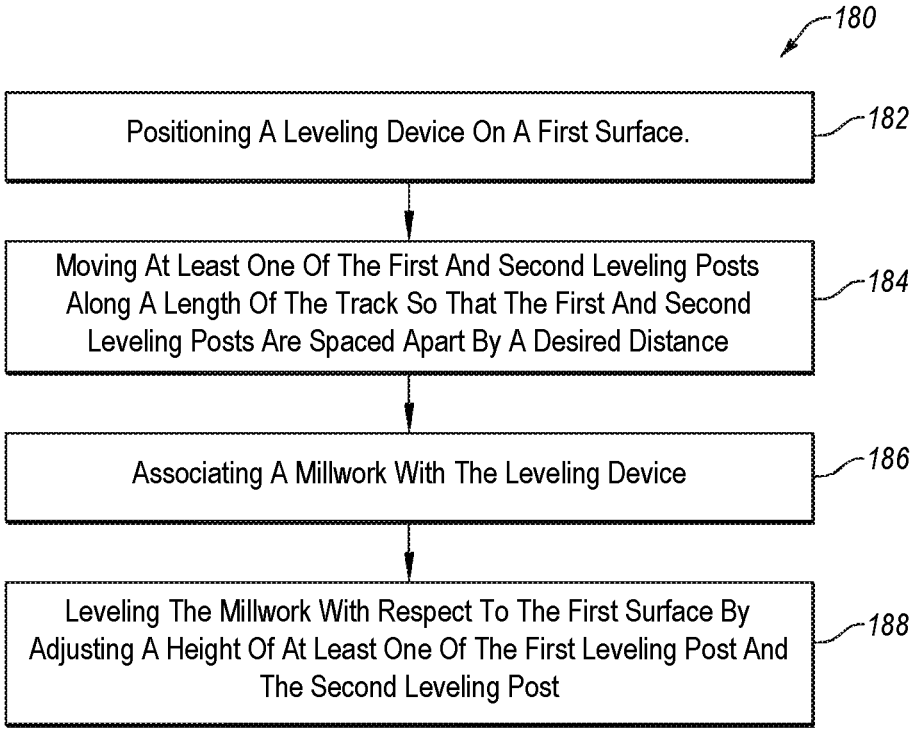
FIG. 6 illustrates a method for leveling millwork according to one or more implementations of the present disclosure.

The present disclosure also includes methods for leveling millwork. With reference to FIG. 6, a method 180 may include positioning a leveling device on a first surface (e.g., a floor, ceiling, wall, top of millwork, etc.) (step 182). The leveling device may include a track, a first post having a first height, a second post having a second height, and a plate having one or more through holes. The plate may be associated with the first post to facilitate attachment of a finishing piece. One or both of the first post and the second post are movably positionable along the track. One or both of the first height and second height may be selectively adjustable.

The method 180 may further include selectively moving at least one of the first and second leveling posts along a length of the track so that the first and second leveling posts are spaced apart by a desired distance (step. For instance, one or both of the first and second leveling posts may be moved along the track so that the first and second leveling posts are spaced apart a distance generally equal to a length of width of a millwork. By way of example, FIG. 3C shows leveling posts 104 after being moved along track 102 so that leveling posts 104 are positioned in desired locations under cabinet 130.

The method 180 may further include associating a millwork with the leveling device (step 186). For instance, associating a millwork with a leveling device may include positioning the millwork on the leveling device (FIGS. 3A-4C) or suspending/hanging the millwork from the leveling device (FIG. 5).

The method 180 may further include leveling the millwork with respect to the first surface by adjusting at least the first height of the first post of the leveling device (step 188).

In one embodiment, method 180 may further include leveling the millwork by adjusting at least one of the first height and the second height until a horizontal axis of the millwork is perpendicular to a line representing the force of gravity.

Figure 7A:
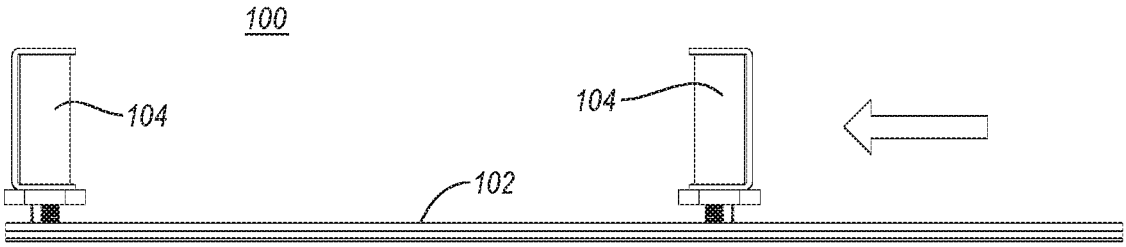
FIG. 7A illustrates a side view of the millwork leveling device of FIGS. 1A through 1C, wherein the horizontal position of one of the leveling posts has been adjusted.
Figure 7B:
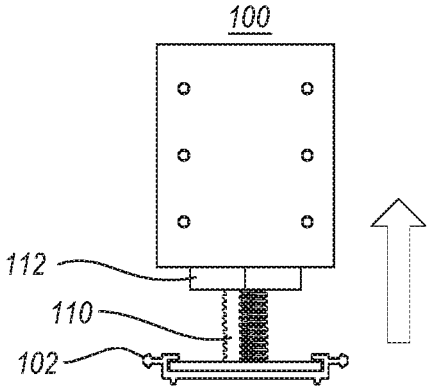
FIG. 7B illustrates an end-on view of the millwork leveling device of FIGS. 1A through 1C, wherein the vertical position of one of the leveling posts has been adjusted.

In some embodiments, and as depicted in FIG. 7A, the horizontal position of at least one leveling post 104 may be adjusted by moving a leveling post 104 along track 102 of leveling device 100 until the leveling posts 104 are spaced apart by a desired distance. Additionally, as depicted in FIG. 7B, in some embodiments the height of at least one leveling post 104 may be adjusted by rotating the height adjustment device 112 along threaded rod 110. It should be appreciated that adjustability in height and horizontal position may be achieved by functional equivalents of the depicted embodiment.

One embodiment of the present disclosure includes a kit for leveling millwork. The kit may include a track, first and second leveling posts, and a plate. In one embodiment, the first and second leveling posts may be height adjustable. Additionally or alternatively, the first and second leveling posts are movably positionable along the track. In one embodiment, the plate may have one or more through holes. Additionally or alternatively, the plate is associated with at least the first leveling post and can have a finishing piece attached thereto.

In one or more embodiments, the kit may include one or more posts where each of the one or more posts includes a plate fixedly attached thereto. A weld may attach the plate to the post. In one embodiment, a manufacturer or installer may releasably attach the plates to one or more posts. A manufacturer or installer may additionally or alternatively connect the plates to the posts in a stationary and/or immovable manner. In another embodiment, a manufacturer or installer may fixedly attach the plates to the post in a manner that allows the relative movement therebetween (e.g., rotation of the plate or the post relative to the other). As another example, a manufacturer or installer may associate the plate with the post in a removable manner.

In one embodiment, a kit includes one or more posts and one or more plates wherein a user may attach the one or more plates to the one or more posts. In one or more embodiment, this may include snappingly attaching a plate to a post, magnetically attaching a plate to a post, or otherwise removably or fixedly attaching a plate to a post.

The present invention may be embodied in other specific forms without departing from its spirit or essential characteristics. Thus, the described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

I claim:

1. A leveling device for leveling millwork, comprising:

a track positioned on a permanent structure;

a leveling post configured to support the millwork and to be movably positioned along the track, wherein both a height and horizontal position of the leveling post are selectively adjustable during installation, such that a surface or edge of the millwork is adjusted relative to the permanent structure in response to adjustment of the leveling post; and a plate fixedly attached to the leveling post, the plate being rotatable about the leveling post and configured to have a finishing piece attached thereto;

wherein:

the plate comprises one or more through holes; and the plate is configured to have the finishing piece attached thereto utilizing the one or more through holes.

2. The leveling device of claim 1, further comprising a second leveling post.

3. The leveling device of claim 2, wherein the second leveling post is configured to be movably positioned along the track.

4. The leveling device of claim 2, wherein a height of the second leveling post is selectively adjustable.

5. The leveling device of claim 1, wherein the finishing piece is a toe kick.

6. The leveling device of claim 1, wherein the finishing piece is a molding.

7. The leveling system of claim 1, wherein the permanent structure is a floor, a ceiling, or a wall.

8. A method for leveling millwork:

positioning a leveling device on a permanent structure, the leveling device comprising a track, a first leveling post, a second leveling post, and a plate associated with the first leveling post;

wherein the track is positioned on the permanent structure;

selectively moving at least one of the first and second leveling posts along a length of the track so that the first and second leveling posts are spaced apart by a desired distance corresponding to a length or width of the millwork;

installing the millwork against the leveling device, such that the leveling device and track are disposed between the millwork and the permanent structure; and leveling the millwork with respect to the permanent structure by adjusting at least a position along the track or a height of at least one of the first leveling post and the second leveling post;

wherein a surface or edge of the millwork is adjusted vertically in response to adjustment of at least one of the first or second leveling post.

9. The method of claim 8, wherein positioning the leveling device on the permanent structure comprises positioning the track in a substantially horizontal orientation.

10. The method of claim 8, wherein positioning the leveling device on the permanent structure comprises positioning the track in a substantially vertical orientation.

11. The method of claim 8, wherein leveling the millwork with respect to the permanent structure by adjusting a height of at least one of the first leveling post and the second leveling post comprises independently adjusting the height of the first leveling post and the height of the second leveling post.

12. The method of claim 8, further comprising attaching a finishing piece to the plate.

13. The method of claim 10, wherein the permanent structure is a floor, a ceiling, or a wall.

14. A system for leveling millwork, comprising:

a track positioned on a permanent structure;

a first leveling post and a second leveling post associated with the track configured to support the millwork and to be movably positioned along the track, at least one of the first and second leveling posts being selectively movable along a length of the track such that a desired distance between the first and second leveling posts may be achieved during installation, the first leveling post having a first height and the second leveling post having a second height, at least one of the first height and the second height being selectively adjustable such that a surface or edge of the millwork is adjusted relative to the permanent structure in response to adjustment of the leveling post; and a plate rotatably secured to the first leveling post, the plate being configured to have a finishing piece attached thereto;

wherein at least one of the first and second leveling posts comprises a threaded rod and a height adjustment mechanism mounted on the threaded rod.

15. The system of claim 14, wherein the track comprises one or more grooves and the at least one of the first and second leveling posts that is selectively movable along the length of the track comprises a base slidably disposable within the one or more grooves.

16. The system of claim 14, wherein the height adjustment mechanism is movably mounted on the threaded rod such that the position of the height adjustment mechanism on the threaded rod can be selectively adjusted to selectively adjust at least one of the first height and the second height.

17. The system of claim 14, further comprising a second plate configured to associate with the second leveling post, the second plate being configured to have a finishing piece attached thereto.

18. The system of claim 14, wherein the permanent structure is a floor, a ceiling, or a wall.

* * * * *